US009574842B2

(12) United States Patent
Tulpa

(10) Patent No.: US 9,574,842 B2
(45) Date of Patent: Feb. 21, 2017

(54) ARCHERY BOW PRESS AND METHOD FOR COMPRESSING AN ARCHERY BOW USING COLLECTIVELY CONNECTED BOW LIMB SUPPORTS

(71) Applicant: Kevin R. Tulpa, Elk Rapids, MI (US)

(72) Inventor: Kevin R. Tulpa, Elk Rapids, MI (US)

( * ) Notice: Subject to any disclaimer, the term of this patent is extended or adjusted under 35 U.S.C. 154(b) by 0 days.

(21) Appl. No.: 14/866,867

(22) Filed: Sep. 26, 2015

(65) Prior Publication Data

US 2016/0040953 A1 Feb. 11, 2016

Related U.S. Application Data

(63) Continuation of application No. 14/018,508, filed on Sep. 5, 2013, now Pat. No. 9,255,760.

(60) Provisional application No. 61/697,746, filed on Sep. 6, 2012.

(51) Int. Cl.
*F41B 5/14* (2006.01)

(52) U.S. Cl.
CPC ..... *F41B 5/1449* (2013.01); *F41B 5/14* (2013.01)

(58) Field of Classification Search
CPC ..... F41B 5/1449
USPC ..... 124/1, 86
See application file for complete search history.

(56) References Cited

U.S. PATENT DOCUMENTS 3,055,655 A * 9/1962 Chelf ..... F41B 5/1449 124/23.1
3,180,620 A * 4/1965 Ramsey ..... F41B 5/1449 254/123
5,022,377 A * 6/1991 Stevens ..... F41B 5/1449 124/23.1
5,222,473 A * 6/1993 Lint ..... F41B 5/1449 124/1
5,370,103 A * 12/1994 Desselle ..... F41B 5/1449 124/23.1
5,433,186 A * 7/1995 Corwin ..... F41B 5/1449 124/1
5,954,041 A * 9/1999 Sands ..... F41B 5/1449 124/1
5,983,879 A * 11/1999 Gifford ..... F41B 5/1449 124/1
6,220,235 B1 * 4/2001 Sands ..... F41B 5/1449 124/1
6,386,190 B1 * 5/2002 Kurtz, Jr. ..... F41B 5/1449 124/1
6,932,070 B1 * 8/2005 Kurtz, Jr. ..... F41B 5/1449 124/1

(Continued)

*Primary Examiner* — Alexander Niconovich
(74) *Attorney, Agent, or Firm* — Northern Michigan Patent Law, PLC

(57) ABSTRACT

An archery bow/crossbow press and method provides operation to various bow designs including bows with past parallel limbs or having limbs with sharp curvatures using collectively connected bow limb supports to engage the outer face of a bow limb for compression; each bow limb support configured with at least one upper and at least one lower support arm wherein each support arm comprises bow limb contact areas that may include various shapes adaptable to engage a bow limb or limb components; each support arm may be positioned against a bow limb independently or collectively with each other; and, when the bow limb supports are positioned collectively on the bow they may be the sole contact of the bow press during the pressing operation.

10 Claims, 13 Drawing Sheets

(56) References Cited

U.S. PATENT DOCUMENTS 6,968,834 B1 * 11/2005 Gibbs ..... F41B 5/1449 124/1
7,185,644 B2 * 3/2007 Kurtz, Jr. ..... F41B 5/14 124/1
7,255,099 B2 * 8/2007 Henry ..... F41B 5/1449 124/1
7,311,095 B2 * 12/2007 Bauder ..... F41B 5/14 124/1
7,597,094 B2 * 10/2009 Pittman ..... F41B 5/14 124/1
7,644,708 B2 * 1/2010 Pittman ..... F41B 5/14 124/1
7,913,680 B2 * 3/2011 Evans ..... F41B 5/10 124/1
8,141,546 B2 * 3/2012 Liu ..... F41B 5/1449 124/1
8,387,600 B1 * 3/2013 Horn ..... F41B 5/1449 124/1
8,402,955 B2 * 3/2013 Tulpa ..... F41B 5/14 124/1
8,505,523 B1 * 8/2013 Horn ..... F41B 5/1449 124/1
8,505,526 B1 * 8/2013 McPherson ..... F41B 5/10 124/23.1
8,733,333 B2 * 5/2014 Barrios ..... F41B 5/1449 124/1
8,746,220 B2 * 6/2014 McPherson ..... F41B 5/10 124/25.6
8,789,518 B2 * 7/2014 Gouramanis ..... F41B 5/14 124/1
8,851,057 B2 * 10/2014 Pulkrabek ..... F41B 5/1449 124/1
9,366,498 B2 * 6/2016 Gouramanis ..... F41B 5/14
2009/0056688 A1 * 3/2009 Marsh ..... F41B 5/14 124/1
2010/0089376 A1 * 4/2010 Bunk ..... F41B 5/14 124/86
2011/0232616 A1 * 9/2011 Gouramanis ..... F41B 5/14 124/1
2014/0331982 A1 * 11/2014 Gouramanis ..... F41B 5/14 124/1
2016/0282078 A1 * 9/2016 Gouramanis ..... F41B 5/14

* cited by examiner

ARCHERY BOW PRESS AND METHOD FOR COMPRESSING AN ARCHERY BOW USING COLLECTIVELY CONNECTED BOW LIMB SUPPORTS

CROSS-REFERENCE TO RELATED APPLICATIONS

This is a continuation of application Ser. No. 14/018,508, filed Sep. 5, 2013 by the same inventor (Tulpa), which in turn claims priority to U.S. Provisional Application No. 61/697,746 filed Sep. 6, 2012 by the same inventor (Tulpa), the entire contents of which prior applications are hereby incorporated by reference.

FEDERAL SPONSORED RESEARCH

Not applicable.

SEQUENCE LISTING

Not applicable.

FIELD

This application relates to archery bow presses, and more particularly to bow presses for stringing, tuning, or installing/removing components of various styles of bows.

BACKGROUND OF THE INVENTION

Archery bow presses are widely used in the archery trade for stringing, tuning, and general maintenance of different types of bows including compound bows, traditional bows and crossbows. The compound bow most commonly uses a levering system of cables and pulleys (cams) to bend a set of stiff limbs attached to a central mount (riser), and is usually left strung with the cables and cams holding the limbs under high tension. The traditional style of bow is usually referred to as a bow with no cams, where the limbs are strung with the bow string secured directly to the limbs. The crossbow is basically a very stiff limbed bow, with or without cams, attached crosswise on a stock having a trigger mechanism for holding the bow in a cocked position.

Through the years bow designs have been changing to keep up with the market's demand for faster and quieter shooting bows, resulting in a wide variety of bows on the market today with varying components and limb styles, including bows that have two limbs instead of one limb attached on either end of a riser, known as a quad limb bow. Many bows have short, swept back more parallel limbs, known as parallel limb bows. Other bows may have thinner limbs that are held under higher tension (preloaded) by the cables and cams, so as to bend the limbs back in a radius curvature toward the opposite limb, past parallel, known as preloaded past parallel limb bows. There are even bows with reverse limbs, where the limbs project out from the riser or a stock, away from the archer. Any one of these different bow designs may include various components attached to the limbs, for example axle hubs (for the cams) mounted to the outside curvature of the limbs, or string suppressors near the tips of the limbs for dampening sound and vibration.

These vast differences in bow designs have proven problematic for many of today's bow presses, which lack a quick and effective means to safely, securely, and effectively press these different bow designs. This is mostly due to the limited number of bow limb contacts readily accessible on the presses, or the inability of the bow limb contacts to effectively support or hold the bow limb during the pressing operation. Also, many of today's bow presses are structurally weak or lack the geometric makeup to effectively press bows with short stiff limbs, such as crossbows.

One of the newer designs of bows and growing very popular are the bows with preloaded past parallel limbs. However, applying force to pre-loaded past parallel (PPL) limbs in order to relax the tension on the strings and cables has proven to be a very cumbersome and sometimes a dangerous practice with current bow presses. PPL bows have limbs with preloaded dynamics and curvatures that have a tendency to distort or flatten out at the bow limb contacts when force is applied to the limbs, resulting in excess stress to the bow limbs and/or to other components of the bow. The bow limb contacts also tend to slide on the bow's limbs, and can possibly slide off the limbs and allow the bow to slip out of the press. This could potentially lead to injury to the operator or damage to the bow.

Bow press manufacturers have tried to remedy the problems of PPL bows slipping out of their presses and excess stress applied to these bows when pressing, with little success. Attempts include techniques such as adding stops or holding devises to their presses to secure a bow by the riser, or clamping a bow limb directly to the press's bow limb contacts, or backing off the bow's limb bolts multiple turns in order to reduce the curvature of the bows limbs. These remedies are not ideal as these fixes may result in one or more of the following: more set up time; a higher level of skill required in setting up the press; a bow limb flexing undesirably; undue stress on various components of the bow; or the bow still losing contact with the bow press.

Accordingly there is a need in the archery industry for a bow/crossbow press that is powerful, diverse, and can safely press a wide variety of bows, including PPL bows with past parallel limbs or having limbs with sharp curvatures; that has multiple bow limb contacts readily accessible on the press, with the ability to effectively support or hold the limbs of a bow during the pressing operation without the bow limb distorting or sliding off the bow limb contacts; and that is structured to safely apply the pressing forces needed for bows having stiff limbs.

SUMMARY

An archery bow/crossbow press for servicing a wide variety of bows including bows with past parallel limbs or limbs with sharp curvatures, is provided with collectively connected bow limb supports, the bow limb supports comprising spaced limb contacts set at an acute angle relative to one another along an arc corresponding to a radius of curvature of a limb of a bow to be pressed, and configured to engage the outer face of a bow limb.

In a preferred form, a dynamic V-shaped bow press provides the power required when pressing stiff limbed bows, comprising a pair of coplanar pivot arms slaved together at their lower ends with a base housing a series of spur gears; the upper end of each pivot arm is pivotally connected to a drive mechanism that moves a pivot arm operatively supporting a slide assembly and the bow limb contacts, where the bow limb contacts move toward or away from the bow limb pressing location. Each slide assembly comprises a slide body, a spline pin mechanism, a pair of collective bow limb supports and a pop pin; each slide assembly is selectively positioned by engaging a pop pin into one of a series of corresponding holes located along the upper length of each pivot arm to accommodate varying bow lengths. The spline pin mechanism can be manipulated to quickly rotate the bow limb supports 360 degrees to a desired bow limb contact location to fit various bow limb types. These and other features and advantages of the invention will become apparent from the detailed description below, in light of the accompanying drawings.

In a preferred form, the bow limb supports are generally V-shaped supports with spaced arms including curved limb contact surfaces.

DETAILED DESCRIPTION OF EXEMPLARY EMBODIMENTS

Figure 1:
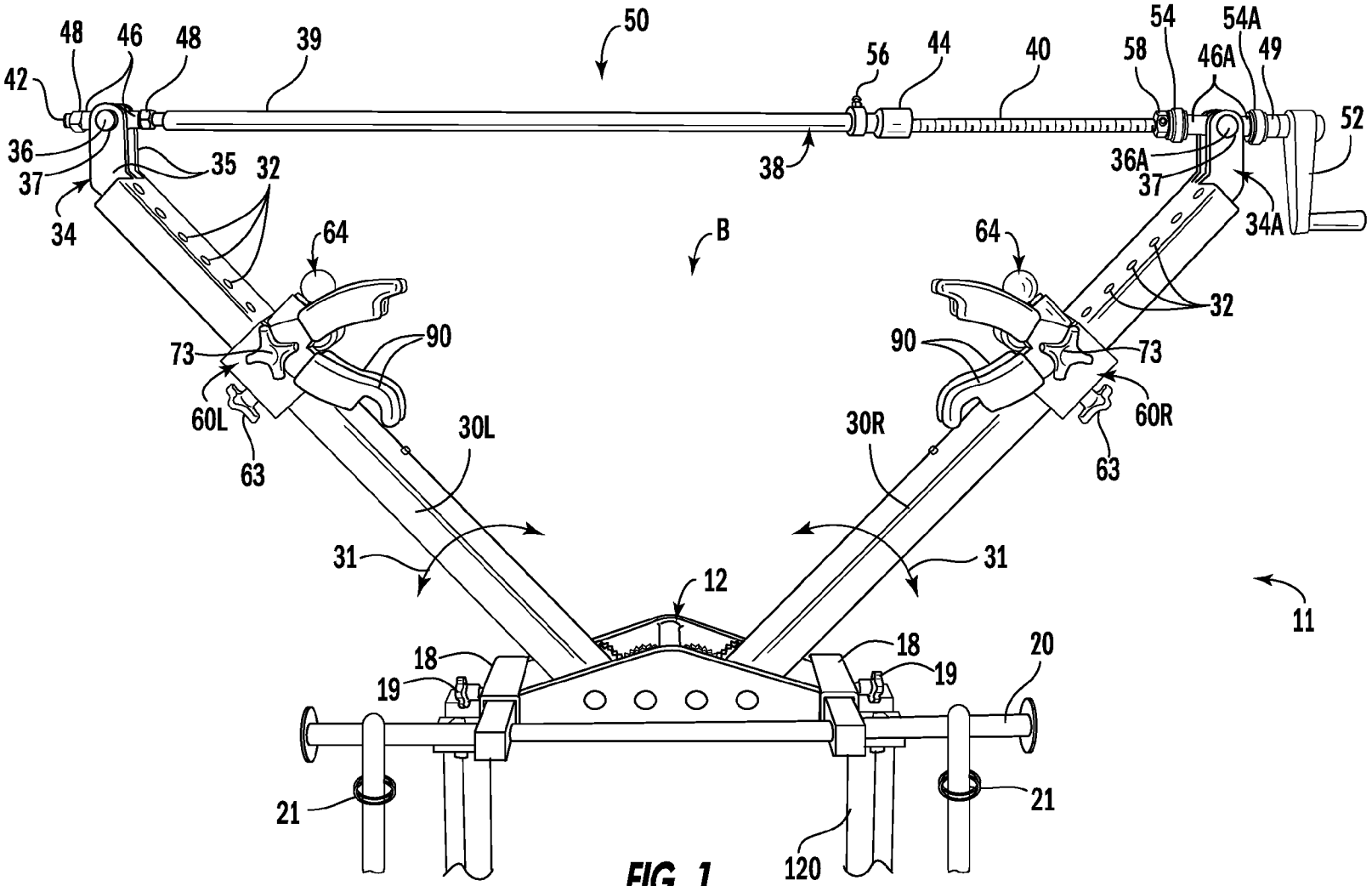
FIG. 1 is a perspective view of a bow press according to an illustrative embodiment of the present invention.
Figure 1A:
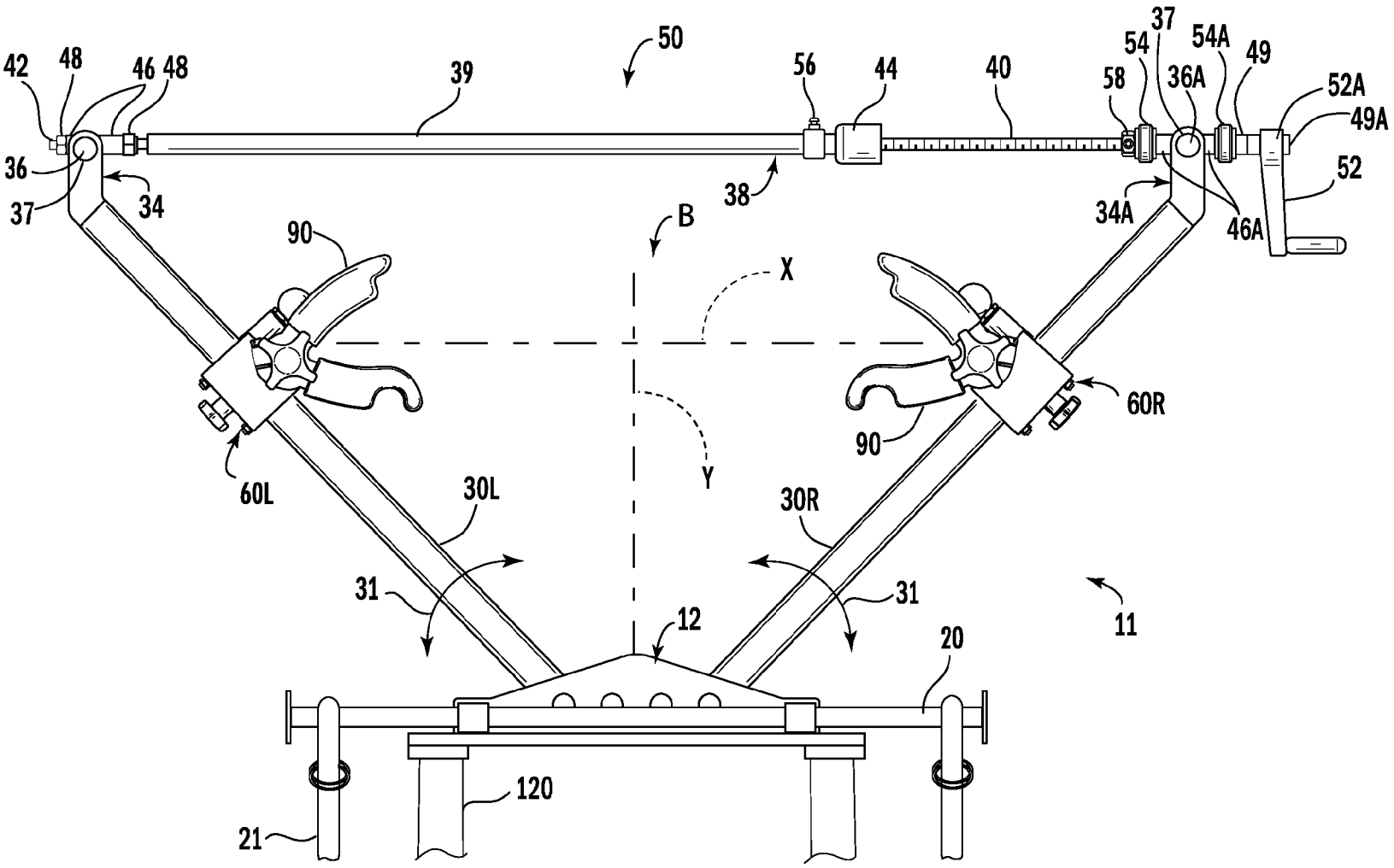
FIG. 1A is a front elevation view of the bow press in FIG. 1

Referring to FIG. 1 and to FIG. 1A, a bow press 11 is shown in exemplary form in order to teach how to make and use the claimed invention. Bow press 11 comprises a base 12, a left pivot arm 30L, a right pivot arm 30R, a telescopic drive mechanism 50, and left and right slide assemblies 60L, 60R; each slide assembly includes a pair of collectively connected limb supports 90. The pivot arms 30L and 30R extend outwardly from base 12 in a V-shape. Both the pivot arms 30L, 30R and base 12 are operatively connected to the telescoping drive mechanism 50, which includes a hand crank 52, so that the pivot arms 30L and 30R are "slaved" to pivot simultaneously and evenly about base 12, toward and away from the bow-receiving location (and any bow secured therein between the pivot arms). The left slide assembly 60L operatively supports a first set of limb supports 90 to receive one or more limbs of a bow, and the right slide assembly 60R operatively supports a second set of limb supports 90 to receive the other limb(s) of the bow.

Base 12 and drive 50 support and move the pivot arms 30L and 30R, along with the slide assemblies 60L, 60R including the limb supports 90, in an arcuate direction 31 toward and away from a bow limb receiving location defined between them, illustrated schematically at B (FIG. 1A).

It will be understood that throughout this description, the bow press 11 will be assumed to be upright, and any directional terms used (up, down, right, left, vertical, horizontal, etc.) are based on this illustrated orientation for convenience. The bow press 11 may, however, be mounted in other orientations, for example rotated 90-degrees from the upright position shown with a bow placed vertical between the pivot arms 30L and 30R.

Let it be known that throughout the following description of the present embodiment that the illustrated structures are formed from metal such as steel or aluminum, although other materials could be used singly or in different combinations, and are joined into a strong, rigid framework using known connections such as welding, structural adhesives, and/or mechanical fasteners.

Figure 2:
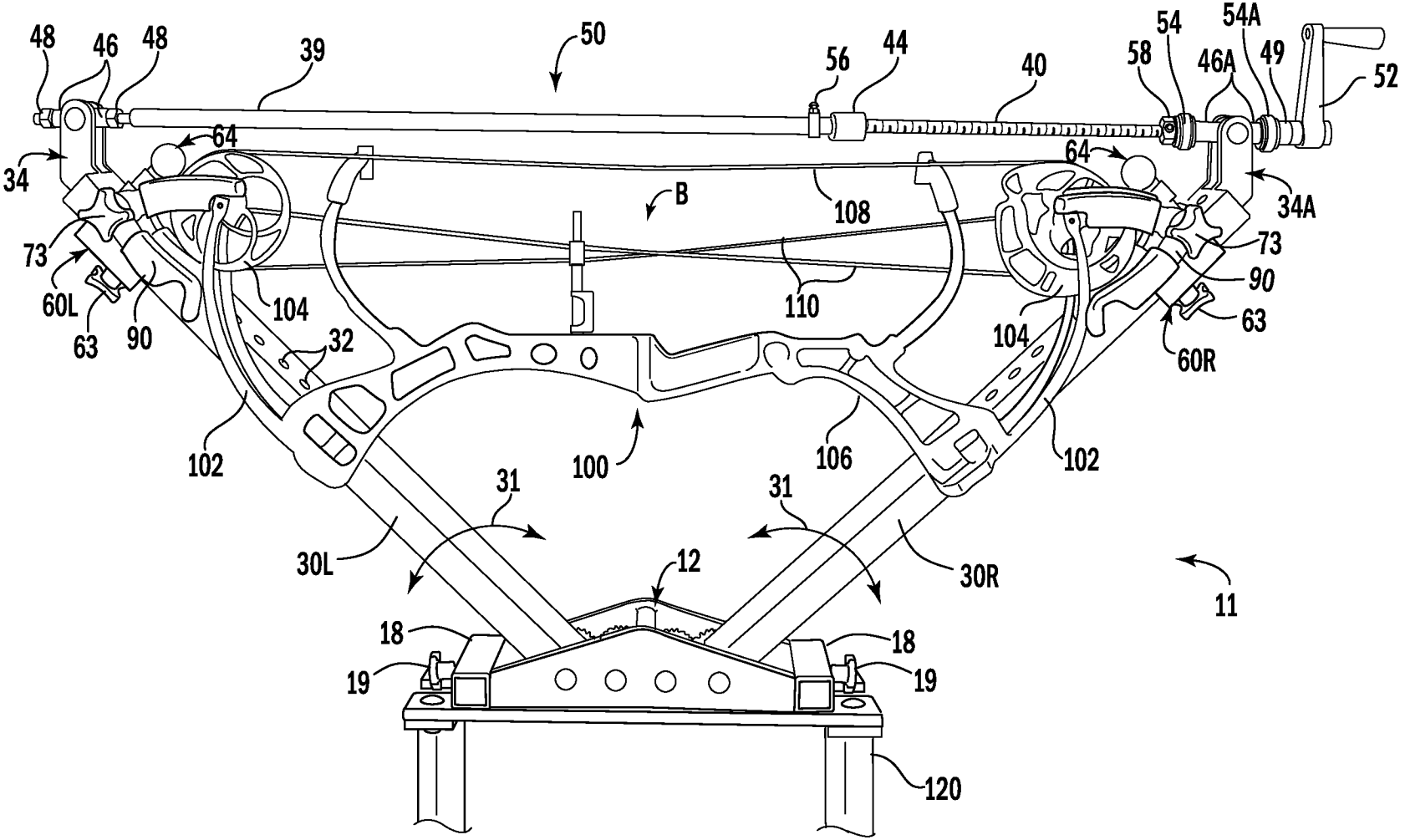
FIG. 2 is similar to FIG. 1, but with a past parallel limb (PPL) bow inserted into the press.

Referring to FIG. 2, a bow 100 is shown secured against the limb supports 90 between the slide assemblies 60R, 60L in the bow receiving location B. Bow 100 is a past parallel limb (PPL) bow having a known combination of riser 106, limbs 102, cams 104, cable 110, and bowstring 108. The illustrated bow is exemplary, and it is believed that the bow press 11 is capable of pressing virtually any make, model, or style of compound bow. It will be understood that although bow press 11 is primarily intended and especially useful for pressing various compound bows having stiff limbs, or past parallel limbs, it may also be used to press crossbows and other styles of non-compound bows if desired. Accordingly, the term "bow" as used herein includes all such types of bow, including crossbows.

Figure 3:
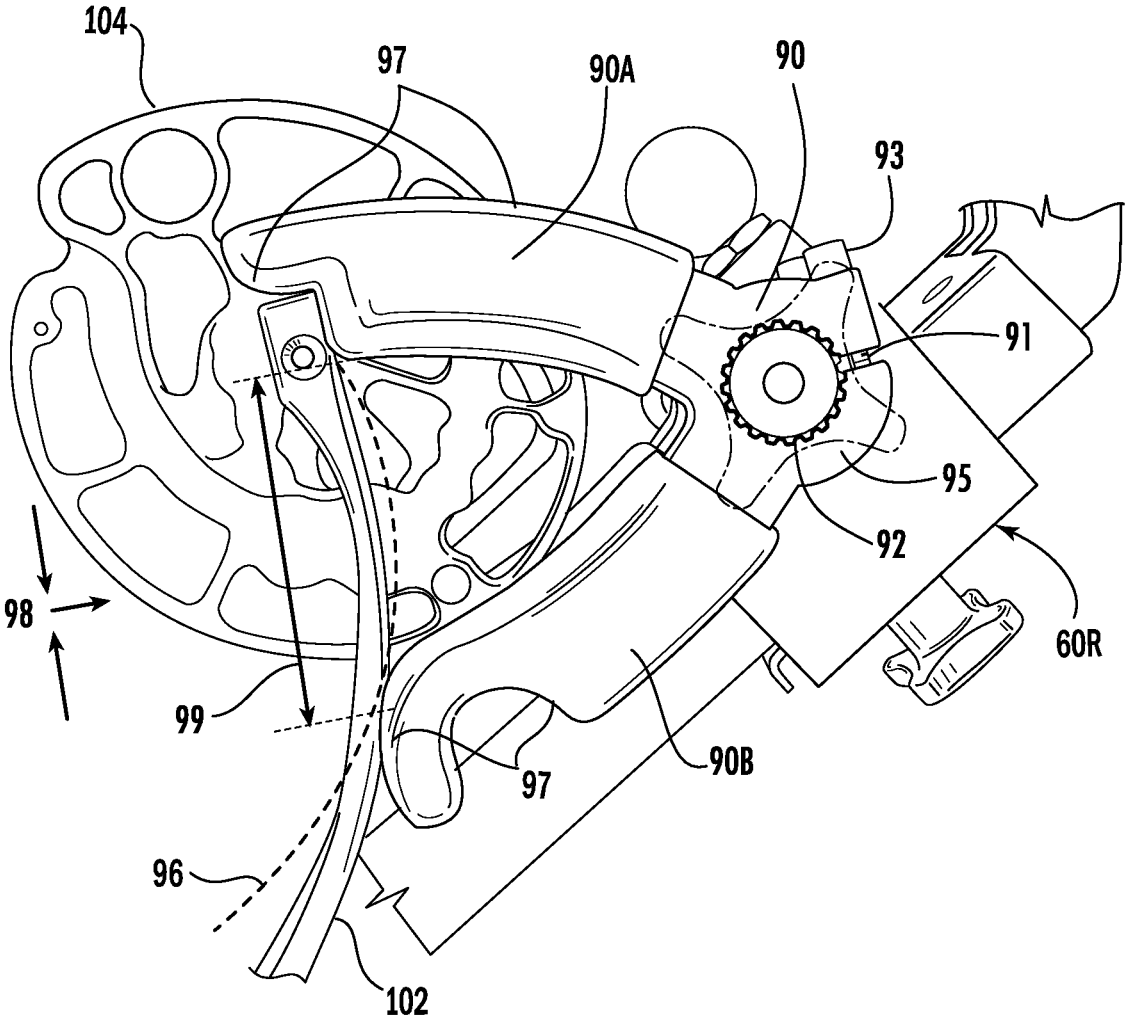
FIG. 3 is a detail view of the right slide assembly of the press if FIG. 1, including a collectively connected bow limb (CCBL) support on the slide assembly, and a bow limb inserted against the upper and lower supports of the CCBL support, and further schematically illustrating how a bow limb is held or captured by the supports during the pressing operation.

FIG. 3 is an illustration to help understand the method of holding or capturing the limb 102 of a bow using the collectively connected limb supports 90 during the pressing operation, that is particularly useful for pressing bows with past parallel limbs, or bows having limbs with sharp curvatures, discussed further on. It should be understood that phrases "limb capture" and "collectively connected" and words such as "collective" or "capture" are meant to describe an action or process of connecting bow limb supports together collectively in order to press a bow, where a collectively connected limb support is defined as follows: a bow limb pressing support that includes at least two bow limb supports operatively connected together to act as a single unified structure, with a space between the supports sufficient to straddle a bow limb's radius of curvature at a flexible portion of the limb, and adequate to flex the bow limb therebetween, while also holding the bow limb during the pressing operation in contact with only the outside curvature of the bow limb.

It will be understood that throughout this description, the illustrated collectively connected limb supports 90 are exemplary, and that the present invention is not limited to the illustrated collectively connected limb supports. It should be also understood that "collectively connected" limb supports are not limited to the illustrated example of a single structure with integrated, spaced support arms, but may also include two or more structures operatively connected together via the bow press for the purpose of acting as a collectively connected limb support as defined above.

Figure 7:
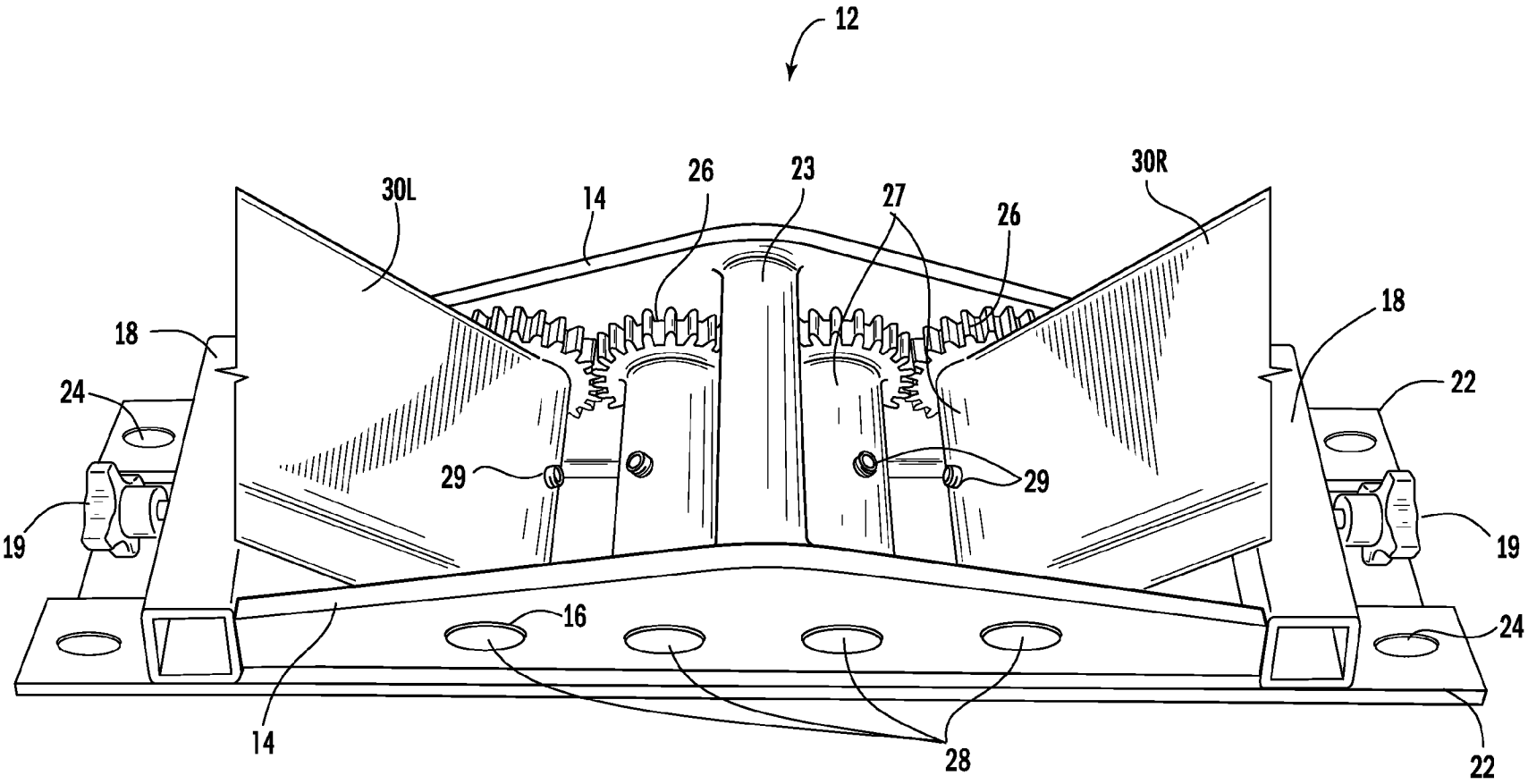
FIG. 7 is a partial perspective view of the bow press in FIG. 1, showing the base and its components for clarity.
Figure 8:
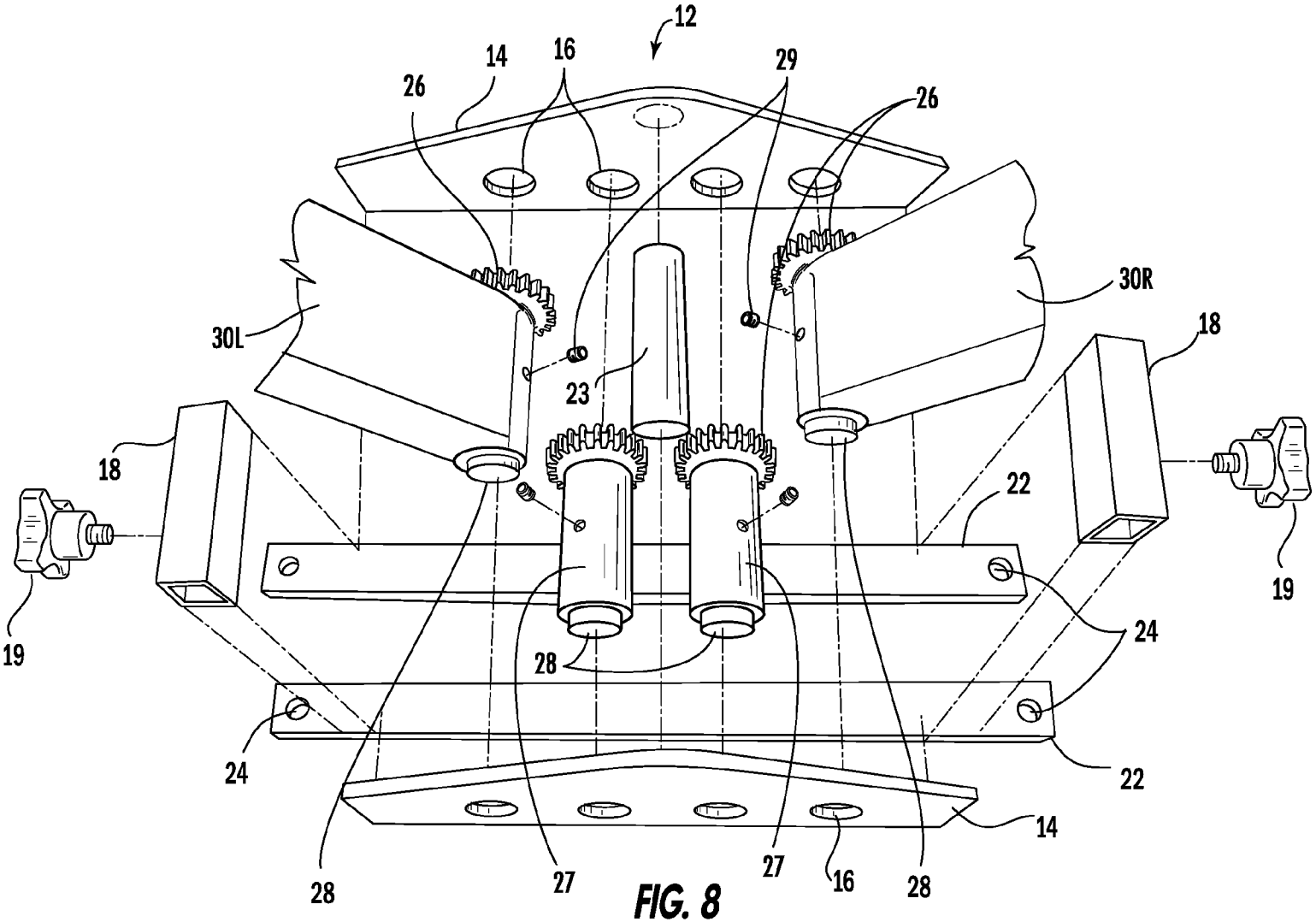
FIG. 8 is an exploded assembly view of the base in FIG. 7.

Referencing FIGS. 1-3 generally, and directing attention to FIGS. 7 and 8 to view individual components of base 12, FIG. 8 illustrates an exploded assembly view of FIG. 7; the base 12 of bow press 11 is a frame mechanically housing a gear assembly providing operative support to the left and right pivot arms, 30L, 30R and providing press 11*a* self supporting portable structure. Base 12 comprises a pair of rigid axle support plates 14 each including four equally spaced axle holes 16 that are structurally affixed parallel to each other between a pair of accessory tubes 18, and a center brace 23. The accessory tubes 18 each include a hand screw securing knob 19 operatively threaded through the side of each accessory tube 18, used to firmly secure any number of add-on accessories designed to mate internally with one or both of the accessory tubes 18, such as a horizontal strap support 20 including two bow holding straps 21 (FIGS. 1, 1A), used mostly for securing an archery bow to the press 11 during the pressing operation when the collectively connected bow limb supports 90 are not positioned on a bow limb "collectively" as defined above. The accessory tubes 18 may also accept other structures (not shown) for example, tool trays, bow holders, or even a structure to hold the stock of a crossbow during the pressing operation. Both the axle plates 14 and accessory tubes 18 are supportably affixed by a pair of cross bars 22. Cross bars 22 may include holes 24 for securing to any number of support surfaces, for example, a portable self-supporting stand 120 (partial view shown in FIGS. 1, 1A, and 2) or other structures such as a work bench, table, wall or floor. Base 12 further includes four spur gears 26 each affixed to a hub 27 and mechanically connected in series to axle plates 14 at each of the axle holes 16 with an axle pin 28 whose ends are trapped in and rotate in the holes; the axle pins 28 extend through the hubs 27 and the gears 26 and are affixed to rotate with the hubs 27 and gears 26 by set screws 29. The ends of pins 28 ride in the axle holes 16 in plates 14. The two outermost hubs 27 with attached gears 26 are affixed to the lower end of each pivot arm 30L, 30R in a timed position, so that the pivot arms 30L, 30R extend outwardly from the base 12 in a coplanar position resembling a V-shape.

Furthermore the gear assembly described in base 12 mechanically slaves pivot arms 30L, 30R together, where the left pivot arm 30L cannot move without the right pivot arm 30R moving an equal distance and both the pivot arms 30L, 30R will only move congruently toward or away from each other. This dependent and synchronized motion is desirable for distributing even pressure to each limb of an archery bow held between bow limb supports 90 during the pressing operation.

Figure 4:
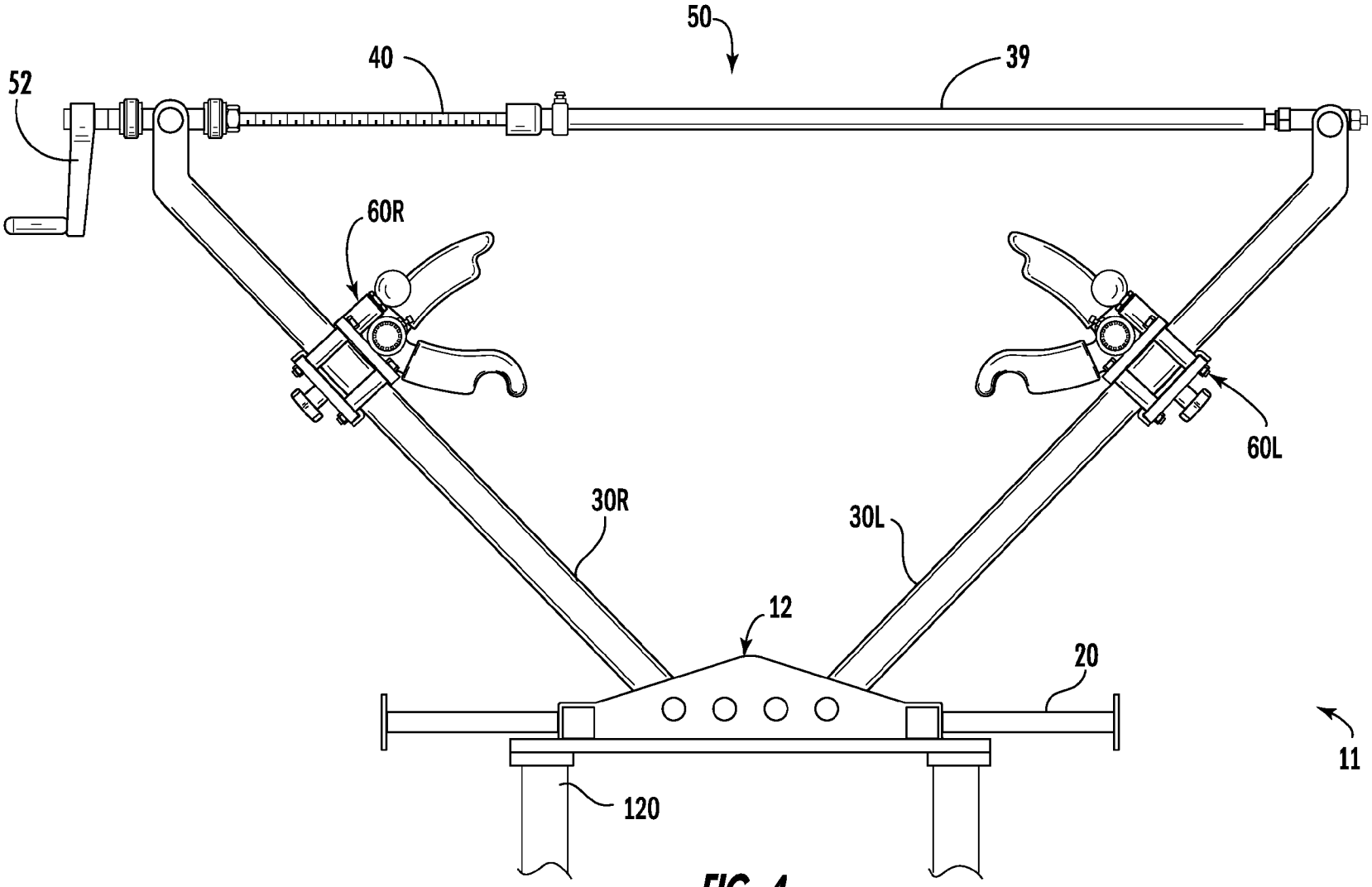
FIG. 4 is a rear elevation of the bow press in FIGS. 1 and 1A.
Figure 5:
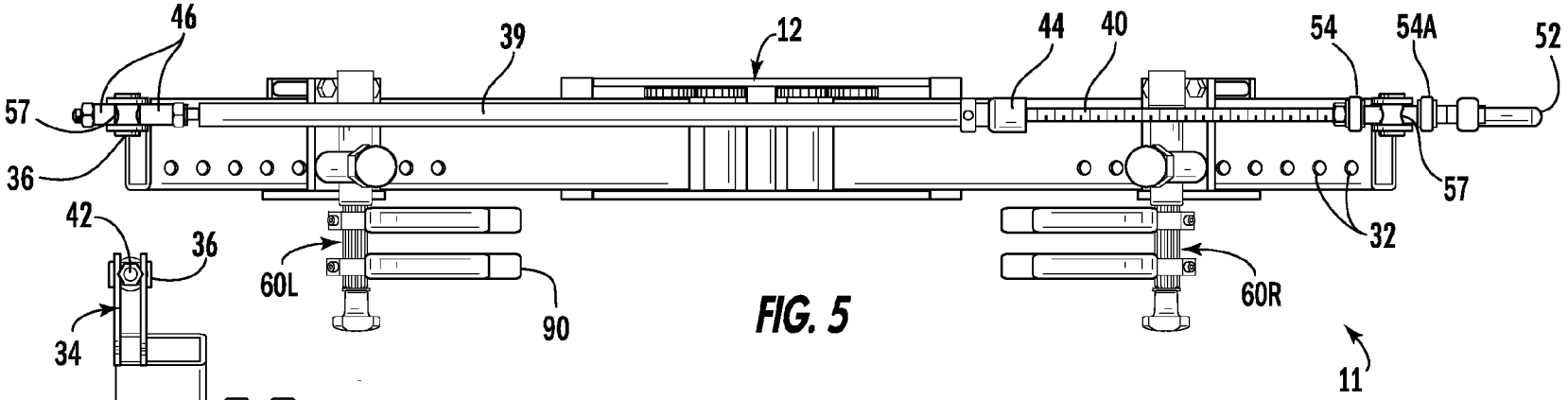
FIG. 5 is a top elevation of the bow press in FIGS. 1 and 1A.
Figure 6:
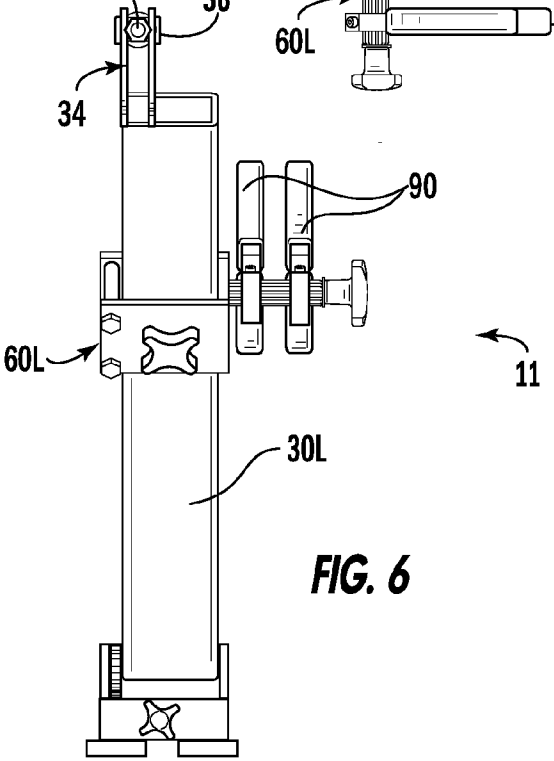
FIG. 6 is a left elevation of the bow press in FIGS. 1 and 1A.

Referring mostly now to FIGS. 1, 1A, and referencing FIGS. 4-6, to view additional elevations of bow press 11; attached to the upper ends of pivot arms 30L and 30R are devises 34 and 34A respectively. Each clevis 34, 34A is identical in shape (as shown in the front view in FIG. 1A). The devises 34, 34A each comprising two alike structural plates 35 (best viewed in FIG. 1) including clevis pin holes 37 to pivotally support a clevis pin 36 or 36A there through. The plates 35 of each clevis are held parallel to each other at a distance apart to allow a space adequate therein to operatively support drive 50 within a radial clearance hole 57 (FIG. 5) through the center of each clevis pin 36 and 36A. Each clevis also pivotally supports drive 50 at clevis pin holes 37.

Drive 50 is a telescoping screw drive mechanism that operatively connects the pivot arms 30L, 30R and base 12 to move the pivot arms supporting the slide assemblies 60L, 60R including the collectively connected bow limb supports 90, simultaneously toward or away from the bow limb receiving location B. Drive 50 comprises a threaded rod 40 that can be made to rotate and move into or out of an extended nut fixture 38 when turning a hand crank 52 attached to the threaded rod 40, or a similar turning device may also be used such as a hand wheel or an electric motor. The extended nut fixture 38 includes a threaded sleeve nut 44 affixed to one end of a hollow tube support 39, so that the threaded rod 40 is operable through the sleeve nut 44 and supported inside the tube support 39; the length of the hollow tube support 39 with the sleeve nut 44 is preferably constructed long enough to accommodate a length of threaded rod 40 to operatively move pivot arms 30L and 30R and the bow limb supports 90 a desired distance to press or un-press the limbs for a variety of bows, or tube support 39 may also be a length comparable to half the distance measured between clevis pins 36, 36A when press 11 is in the fully opened position; the other end of tube support 39 is affixed to a threaded support pin 42. The extended nut fixture 38 may also include a grease fitting 56 located on the tube support 39 near the sleeve nut 44, to supply the fixture with adequate lubrication; nut fixture 38 is prevented from turning in order to operate with the threaded rod 40, with the support pin 42 positioned through the clearance hole 57 in clevis pin 36, and spacers 46 secured against both sides of clevis pin 36 using threaded nuts 48. Threaded rod 40 extends out linearly from the nut fixture 38 and is operatively supported through the clearance hole 57 in clevis pin 36A, and further extends past the clevis pin 36A (clevis 34A) at a distance to allow room to affix the illustrated hand crank 52. Hand crank 52 includes a hub 52A where threaded rod 40 may be positioned there through and secured to the hub with threaded nuts 49 and 49A. Threaded rod 40 also axially supports two thrust bearings 54 and 54A located along its length near hand crank 52 and clevis 34A; the thrust bearings provide the drive mechanism 50 with a smooth operation during axial loading when operating the bow press. The bearings 54, 54A are positioned on either side of clevis pin 36A with spacers 46A separating the bearings from the clevis pin; the bearings and spacers are held on each side of clevis pin 36A with a loose fit between stop nut 58 and threaded nut 49. This "loose fit" allows the threaded rod 40 to freely spin in the clearance hole 57 supplied through clevis pin 36A, avoiding any binding there through between clevis pin 36A and threaded rod 40.

FIG. 1 shows the upper end of inclined pivot arms 30L, 30R each have a matching series of linear location holes 32, for ease of adjustment when setting up bow press 11 to accommodate bows of varying lengths, and for precisely locating the left and right slide assemblies 60L, 60R in the same position when pressing a bow; this precise positioning is desirable for distributing even pressure to the bow press and a bow during the pressing operation. Each set of locating holes 32 may include any number of holes, or any given space between the holes, to position the slides 60L and 60R equal distances relative to each other along the length of the pivot arms 30L, 30R respectively.

Figure 9:
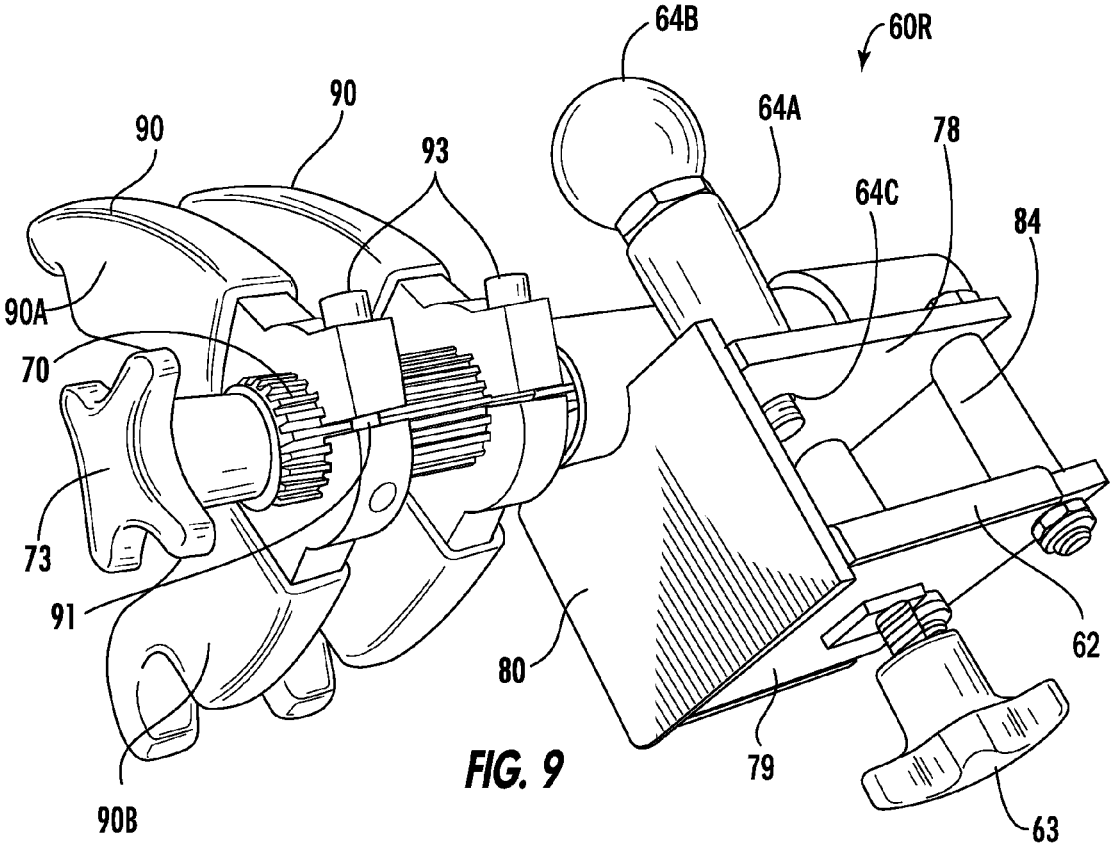
FIG. 9 is a perspective view of the right slide assembly of the bow press in FIG. 1, shown disassembled from the main press of the present invention for clarity.
Figure 9A:
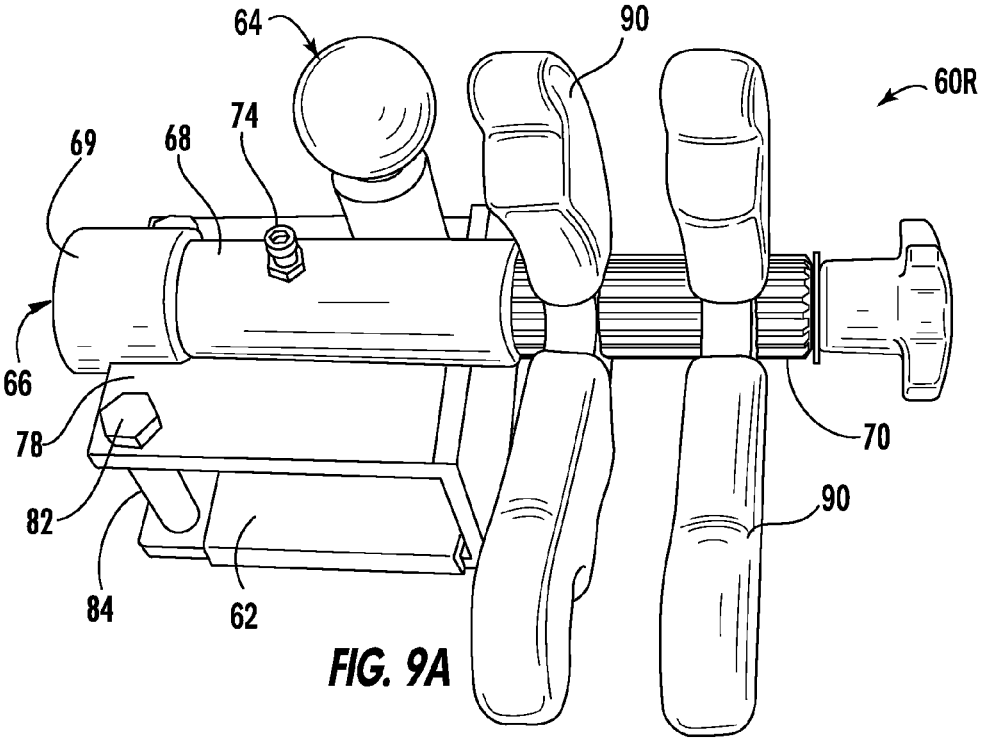
FIG. 9A is similar to FIG. 9, but showing a different perspective view to help view components.
Figure 9B:
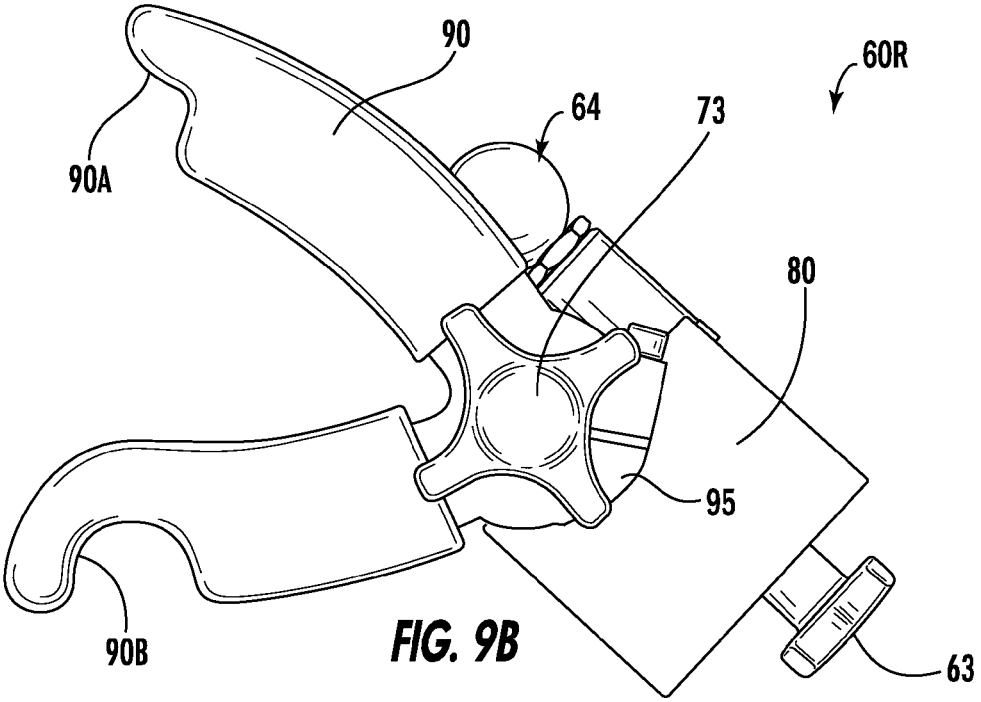
FIG. 9B is a front elevation of the right slide assembly in FIG. 9
Figure 9C:
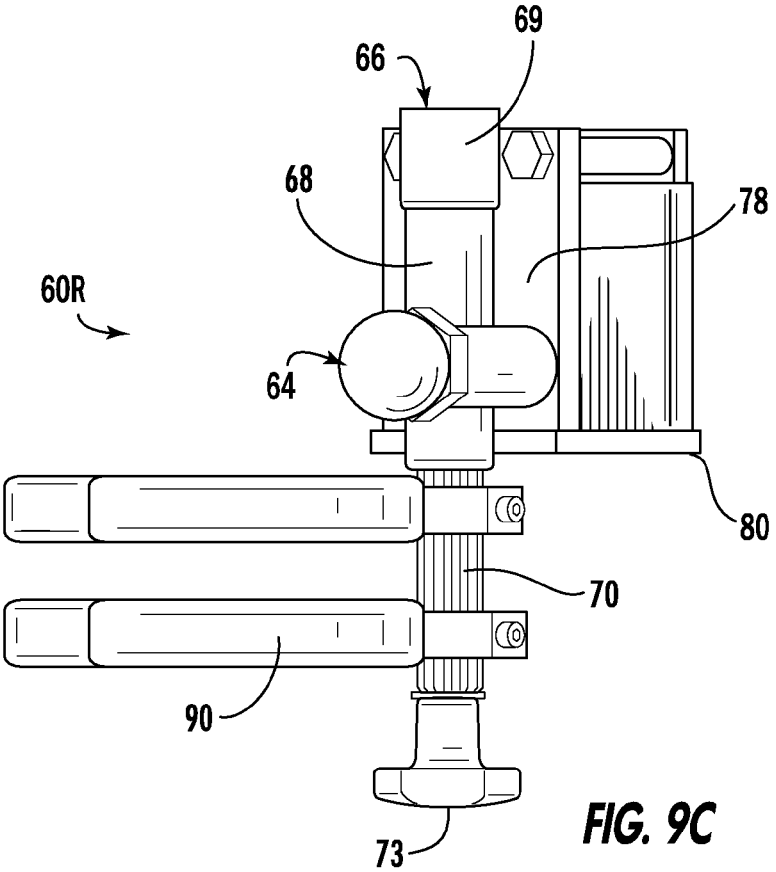
FIG. 9C is a top elevation of the right slide assembly in FIG. 9
Figure 10:
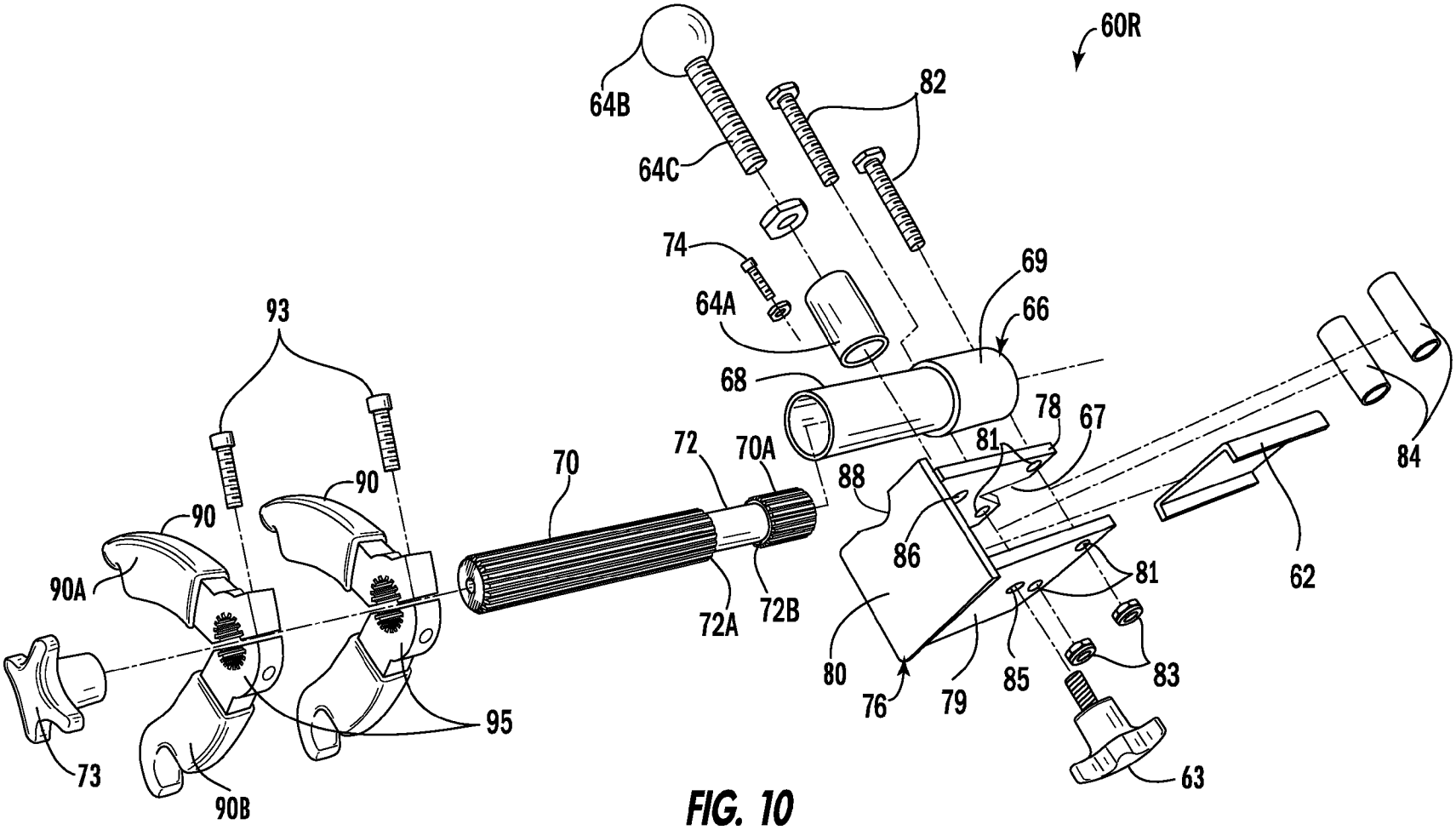
FIG. 10 is an exploded assembly view of FIG. 9 showing details of the slide assembly.

Referencing FIGS. 1-3 and referring now to FIGS. 9-10, to illustrate the right slide assembly 60R of bow press 11 with FIG. 10 showing an exploded assembly view of FIG. 9, the right slide assembly 60R is shown disconnected from the bow press for clarity; left assembly 60L is essentially mirror-image identical and is not shown for brevity. Let it be understood that both slide assemblies 60L and 60R may be constructed with the same components but are considered handed and may be constructed by simply turning or flipping a component over during the assembly process. Each slide assembly 60L, 60R comprises; a slide body 76, a spline pin mechanism 66, and a pair of bow limb supports 90, or if desired a single bow limb support 90 may be used. The slide body 76 is constructed to loosely fit over the pivot arm 30L or 30R respectively, and operatively support the spline pin mechanism 66 attached to its top plate 78; the spline pin mechanism 66 includes a spline pin 70 that slidingly and rotatively supports the bow limb supports 90.

The slide body 76 provides the slide assembly adjustable positioning along the length of its respective pivot arm 30L or 30R within its working range, and operatively supports the spline pin mechanism 66 attached to its top plate 78. The slide body 76 comprises a top plate 78, a bottom plate 79, and a front plate 80, fixed together as to resemble a u-shaped channel with the top and bottom plates spaced apart and held parallel, by affixing one end of each plate 78, 79 perpendicular to the top and bottom edges of the front plate 80. The plates 78, 79 are also held parallel on the open end of the slide body, opposite front plate 80, with spacers 84 positioned near the open corners of each plate 78, 79 between a pair of top and bottom plate bolt clearance holes 81, and secured with bolts 82 and nuts 83. The front plate 80 includes a radius notch 88 centered on its top edge adjacent to top plate 78 to accept the spline pin mechanism 66; accordingly, the top plate 78 includes a spline nut cut out 67 (shown in FIG. 10) centered between the bolt clearance holes 81 to accept the other end of the spline pin mechanism 66. The bottom plate 79 includes a threaded hole 85 extending through the center of its main surface; threaded hole 85 accepts a slide plate tension knob 63, to apply pressure against a tension plate 62, in turn, the tension plate 62 applies pressure between the slide body 76 and its mated pivot arm 30R or 30L on the press, and allowing the slide body 76 to be secured in a locked position anywhere within its operable range along the length of the pivot arm. The slide body 76 may also include a pop pin 64 utilized to locate the slide assembly 60R or 60L incrementally along the length of a pivot arm through one of the locating holes 32. Pop pin 64, (a device commonly known in the industry) includes a housing 64A, an actuating knob 64B, and a retracting pin 64C. Housing 64A is affixed perpendicular on the exterior surface of the top plate 78 centered over a pop pin clearance hole 86; the retracting pin 64C operatively extends through the bottom of the top plate 78 to engage the slide body 76 into a locating hole 32; actuating knob 64B retracts the pin 64C to disengage the slide body from the locating hole 32.

The spline pin mechanism 66 includes a spline pin 70 to operatively support the bow limb supports 90 and provide rotative 360 degree sequential positioning to the bow limb supports 90. The spline pin mechanism 66 comprises a spline pin 70, a hollow tube 68, and a broached bushing 69 that matches the spline of pin 70. The bushing 69 is attached to one end of the tube 68, so that when pin 70 is inserted through tube 68, it can freely move into or out of the bushing 69. The spline pin mechanism 66 is secured to the slide body 76 on the top surface of the top plate 78, positioned with bushing 69 seated into the spline nut cut out 67 (FIG. 10), and tube 68 positioned into the radius grove 88 so that the tube 68 contacts the top surface of plate 78. Pin 70 is operatively supported through the tube 68, and can freely rotate 360 degrees within the tube, or may be rotated 360 degrees to any position aligned with a position defined by bushing 69 and then set and held in that position sequentially by inserting splined end 70A into the bushing 69. Spline pin 70 is rotated with a spline pin control knob 73 attached to the end of the pin 70. Pin 70 is configured with a spline pin cut out area 72 (FIG. 10), recessed in from its outside diameter, including a first edge 72A and a second edge 72B, and positioned near the end of the pin 70, opposite the control knob 73, as to allow a small section of spline 70A of pin 70 remaining; pin 70 is positioned inside tube 68 with a stop screw 74 threaded and held through the wall of tube 68 and into the spline pin cut out area 72 of pin 70, so that the stop screw 74 is just shy of contacting the surface of the cut out area 72 between edges 72A, 72B; pin 70 is considered fully engaged into bushing 69 when the stop screw 74 contacts edge 72A, and the section of spline 70A of pin 70 is positioned inside bushing 69; accordingly, pin 70 is fully disengaged from bushing 69 when pin 70 is retracted away from the bushing 69 and screw 74 contacts edge 72B, and section 70A no longer contacts bushing 69.

Let it be understood that even though the spline pin mechanism 66 is a novel feature of the present invention, the spline pin mechanism 66 may also include other embodiments to control the adjustable 360 degree rotation and position-setting of the spline pin 70. For example, the function of the spline bushing 69 may be performed with a worm gear apparatus or even a ratcheting mechanism for equivalent adjustment and control of pin 70.

The collectively connected bow limb supports 90 each include coplanar upper and lower bow limb support arms 90A and 90B, each of the support arms 90A, 90B including multiple bow limb contact areas 97 (FIG. 3) that may be used independently from or "collectively" with each other, depending on the rotational angle at which bow limb support 90 is set with respect to a bow's limb via the spline pin mechanism 66, in order to press a wide variety of bows. The bow limb support 90 comprises an upper bow limb support arm 90A with a notched end defining a notch or shoulder 97*a*, a lower bow limb support arm 90B with a radiused end 97*b*, and a central hub 95 collectively connecting support arms 90A and 90B. The upper and lower limb support arms 90A, 90B project outwardly from the central hub 95 in a general v-shape so that the upper and lower limb support arms 90A and 90B are collectively connected together to act as a single unified structure when both are in contact with the outer curvature of a bow limb. Central hub 95 also includes a broached hole 92 that matches the spline of pin 70, a relief cut 91, and a tension screw 93. The support 90 is inserted onto spline pin 70 through the broached hole 92 and may be positioned anywhere along the length of pin 70 within its range to accommodate any bow limb width; when the bow limb width is perpendicular to both the X and Y axis in the bow receiving location B shown in FIG. 1A. Support 90 is then secured in the desired position along the length of pin 70 by tightening the tension screw 93.

Figure 3A:
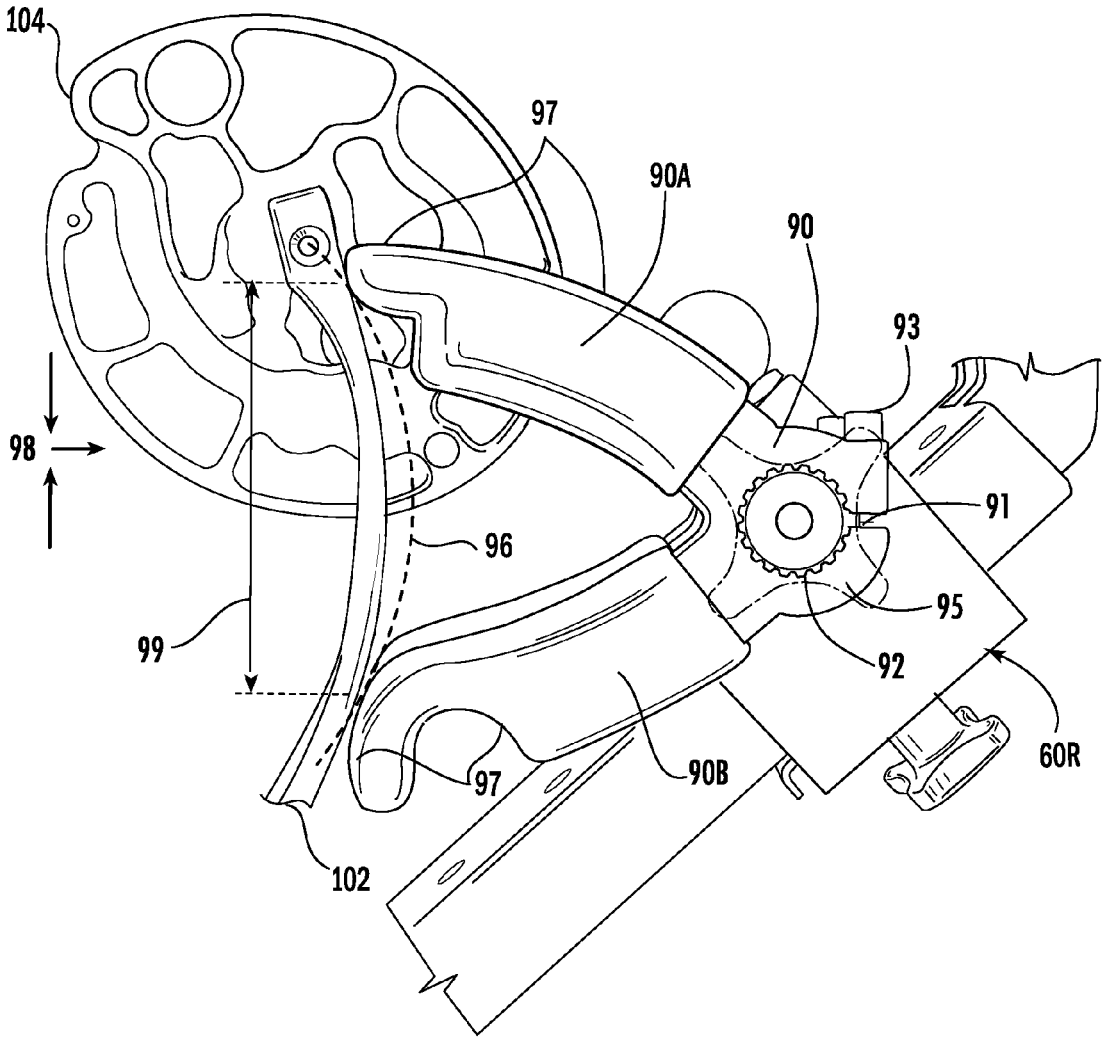
FIGS. 3A and 3B illustrate the bow limb support of FIG. 3 in different rotational positions to engage a bow limb differently.
Figure 3B:
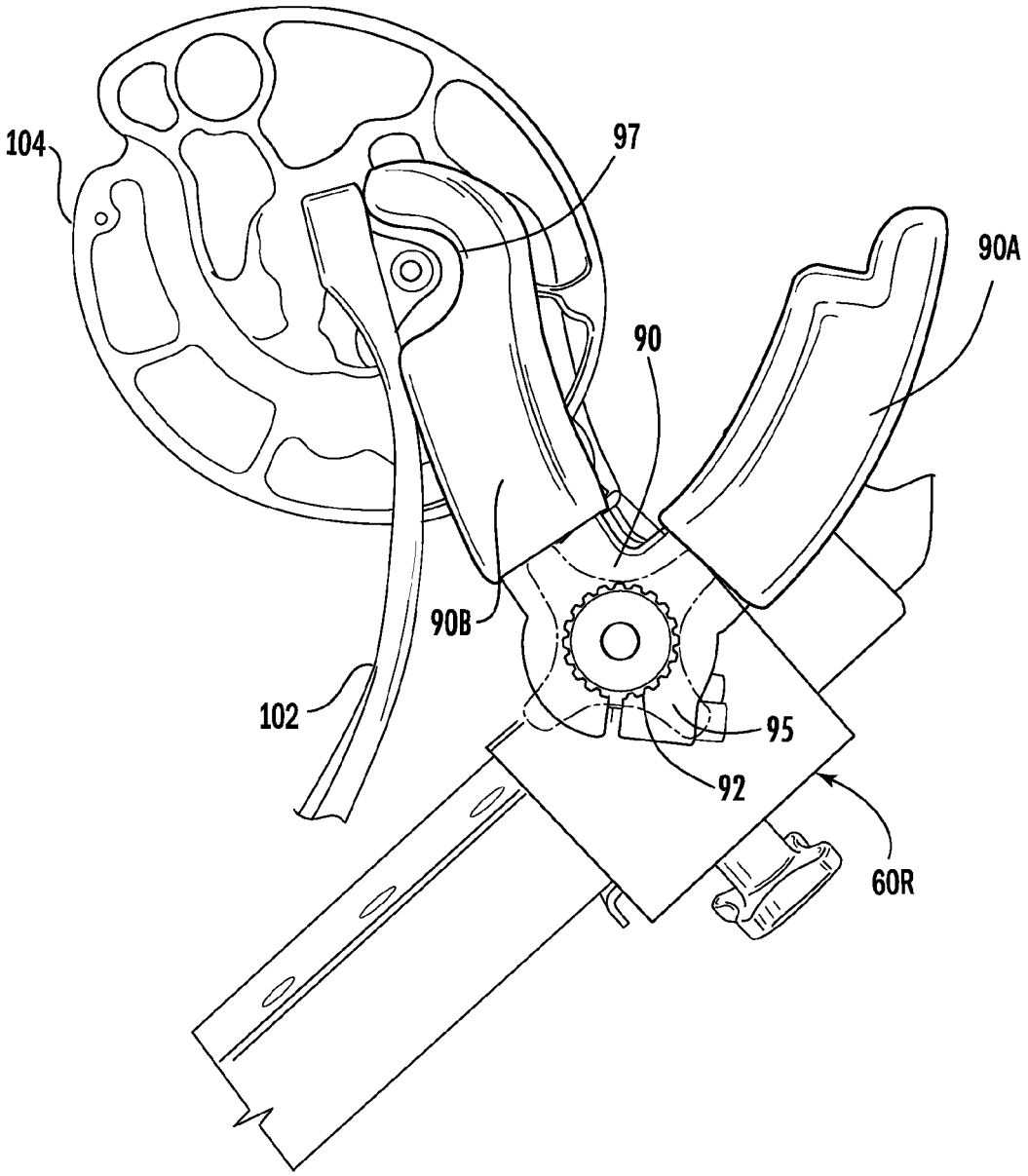

FIG. 3 illustrates the function of the bow limb supports 90, showing an isometric view of the right slide assembly 60R of the present invention and a partial view of a bow limb 102 positioned against the upper and lower bow limb support arms 90A and 90B of one of the press' supports 90, so that the supports arms are functioning as "collectively connected" bow limb supports for pressing bows with sharp curvatures or past parallel limbs. FIG. 3 further schematically illustrates how the bow limb 102 may flex along an arc 96 and move in directions 98 during the pressing operation in order to keep the bow limb 102 secured against the limb support arms 90A and 90B and hold the bow in the press. The support arms 90 when set to contact a bow limb "collectively" (i.e., both in contact with the bow limb) may also be positioned, if applicable, anywhere along the length of the outside curvature of a bow limb using only the outermost surface of the bow limb, and not just over the limb's center-of-curvature end region 99 near cam(s) 104 as illustrated, in order to secure a bow to the press. However, the exact location where a bow is best secured by support 90 is a matter of ordinary skill in the art, and/or provided by a bow manufacturer, and may vary. Securing different types of bow along different locations on their limbs may also involve rotational adjustment of the bow limb support arms 90A and 90B, such that inner, outer, and end regions of contact surfaces 97 may be utilized in various combinations. A few non-limiting examples of such alternate positions and limb-securing locations are shown in FIGS. 3A and 3B. Each bow limb support 90 provides a space 99 between the upper and lower limb support arms 90A, 90B at a distance adequate to allow the bow limb 102 room to flex 96 therebetween. During the pressing operation the bow limb 102 has a tendency to travel in the directions 98, indicating that bow limb 102 has a tendency to move in opposing directions along its linear length toward and away from the cam 104 and also in an inward direction toward central hub 95, thereby allowing the bow limb 102 to flex 96 slightly into the space 99 between the upper and lower limb supports 90A, 90B in a manner that increases the coefficient of friction between the surfaces of the bow limb 102 and the bow limb contact areas 97 on the upper and lower limb supports 90A, 90B, thereby holding the bow limb 102 securely to the support(s) 90 and preventing the bow limb 102 from losing contact with the collective support(s) 90 or bow press 11. The coefficient of friction between the support arms 90A and 90B can further be improved by applying a friction enhancing surface treatment to contact surfaces 97, for example by dip-coating the ends of the support arms with a rubber-like compound.

The exemplary embodiment of bow press 11 as illustrated in FIGS. 1-10, will be better understood from the following description of its manner of use. Bow press 11 is initially adjusted to suit the length of the past parallel limb bow 100 by manually moving each of the slide assemblies 60L, 60R anywhere within their workable range along the longitudinal axis of the left and right pivot arms 30L, 30R, respectively, to a desired position, usually with each slide assembly 60L, 60R engaged over a corresponding locating hole 32, so that the collective bow limb supports 90 contact the opposing bow limbs 102 on either side of the riser 106 of bow 100 at a location on the outside curvature of the bow's limbs, usually at a more flexible part of the bow's limbs or an area specified by the bow manufacturer.

Each slide assembly 60L, 60R is adjusted by first loosening the slide plate tension knob 63 then disengaging the pop pin 64 from the linear locating hole(s) 32 by pulling up on the actuating knob 64B; the slide assemblies 60L, 60R are secured to the pivot arms 30L, 30R when the pop pins 64 are fully reengaged with the retracting pin 64C set into a desired locating hole 32 and the tensioning knobs 63 are tightened to apply sufficient pressure against the tensioning plates 62 and the pivot arms 30L, 30R respectfully, thereby locking the slide assemblies firmly to their corresponding pivot arms.

The initial fit is also adjustable by turning the hand crank 52 of the drive mechanism 50 to move the bow limb supports 90 toward or away from bow 100. The bow limb supports 90 are then positioned by manipulating the spline pin 70 using the spline pin mechanism(s) 66 to fit the angle and radius of the bow limbs 102 by pulling out on the spline pin control knob 73 until the edge 72B of the cutout 72 contacts the stop screw 74 thereby disengaging the small section of spline 70A from the broached bushing 69, and enabling the spline pin 70 to freely rotate axially 360 degrees inside of the hollow tube 68; the spline pin control knob 73 is then rotated to position the collective bow limb supports 90 against the bow limb(s) 102, so that both the upper and lower bow limb support arms 90A, 90B of each bow limb support 90 contacts the surface of a corresponding bow limb 102; the bow limb supports 90 are then secured in place by pushing in on the spline pin control knob(s) 73 until the stop screw 74 contacts the edge 72A on the pin 70, thereby fully engaging the spline pin 70 securely into the broached bushing 69.

The bow limb supports 90 may also be each separately adjusted to accommodate the width of the bow limb 102 (the width that runs parallel with the length of a bow cam axle), if necessary, by loosening the tension screw 93 then manually sliding the limb support 90 on the spline pin 70 toward or away from the adjacent limb support 90 and tightening the tension screw 93 against the central hub 95, thereby reducing the gap in the relief cut 91 and decreasing the diameter of the broached hole 92 for a snug fit on spline 70.

After the initial fit bow 100 is pressed by engaging the movement of press 11; turning the hand crank 52 in a direction that retracts the drive mechanism 50 until pressure between the collective bow limb supports 90 and the bow limbs 102 holds the bow 100 securely and safely to the press 11; drive 50 retracts when the threaded rod 40 threads into the extended nut fixture 38 through the sleeve nut 44 and into the hollow tube 39; as the threaded support pin 42 holds the extended nut fixture 38 securely through the clevis pin 36 between the spacers 46 and the threaded nuts 48, the spacers 46 rotate between the structural plates 35 of the clevis 34 and preventing the nut fixture 38 from turning as it's transversed by the threaded rod 40; the threaded rod 40 simultaneously rotates through the center of the clevis pin 36A and the thrust bearings 54, 54A while spacers 46A hold the thrust bearings 54, 54A apart, thereby allowing the thrust bearings 54, 54A room to rotate around the perimeter of the clevis 34A while the threaded rod 40 rotates between the structural plates 35 of the clevis 34A, thus pulling the left and right devises 34, 34A along with the left and right pivot arms 30L, 30R toward each other.

As drive 50 moves the left and right pivot arms 30L, 30R toward the bow 100, the base 12 operatively holds the pivot arms 30L, 30R in an upright coplanar position while allowing movement to the pivot arms. The base 12 controls this movement when the four spur gears 26 connected in series force the left and right pivot arms 30L, 30R to rotate in opposite directions, toward or away from the other, as the two outermost spur gears 26 fastened to the pivot arms 30L, 30R rotate opposingly in opposite directions, they in turn rotate the two adjacent center most spur gears 26 in a corresponding opposite directions, thus resulting in the desired movement. Furthermore, as the spur gears 26 with the attached hubs 27 rotate, they also rotate the axle pins 28 within the circumference of the axle holes 16; the axle holes 16 are equally spaced between each other on the axle plates 14 at a distance to allow minimal backlash between the spur gears 26, giving the bow press 11 a firm and stable operation. Bow 100 is considered fully pressed when string 108 and cables 110 become slack.

Thus, since the bow press 11 provides bow limb supports 90 with collectively connected, spaced support arms in this embodiment, it avoids the problem of a bow slipping off the bow limb supports and possibly out of the press, in particular, bows having past parallel limbs have become most difficult to press as many prior art bow presses have experienced.

In the preceding description, various aspects and examples and configurations of making and using the invention as defined by the claimed subject matter have been described, for purposes of explanation, to provide a thorough understanding of claimed subject matter, and to enable those skilled in the art to make and use claimed subject matter. However, these are merely example illustrations and descriptions of inventive concepts wherein other illustrations may apply as well, and the scope of claimed subject matter is not limited in these respects. It should be apparent to one skilled in the art having the benefit of this disclosure that claimed subject matter may be practiced without being limited to the specific details of the disclosure. In other instances, well known features were omitted and/or simplified so as not to obscure claimed subject matter. While certain features have been illustrated and/or described herein, many modifications, substitutions, changes and/or equivalents will now occur to those skilled in the art. It is, therefore, to be understood that the appended claims are intended to cover all such modifications and/or changes as fall within the true spirit of invention as reflected by the preceding disclosure. It should be further understood that to the extent the term "invention" as used in the written specification, is not to be construed as a limiting term as to the number or type of claimed or disclosed inventions, or to limit the scope of any such inventions, and does not exclude discoveries or designs; rather, it is a term which has long been conveniently and widely used to describe new and useful improvements in technology.

What is claimed is:

1. In an archery bow press comprising a frame supporting a pair of opposing arm members defining a bow limb receiving location between them and movable toward and away from each other with a drive mechanism to press opposing limbs of a bow, a collective support on each arm member for applying force to a respective bow limb to compress the bow, each collective support comprising:

a central hub configured to mechanically mount the collective support to the arm member;

an upper bow limb support arm and a lower bow limb support arms fixed to the central hub as a single unified structure;

a bow limb contact area incorporated into each of the upper and lower bow limb support arms for simultaneously contacting the outer curved face of the respective bow limb;

the upper and lower bow limb support arms set in a fixed position on the central hub, and projecting outward from the central hub in a common plane at an acute angle relative to one another to terminate at the bow limb contact areas, the upper and lower bow limb support arms configured to straddle an arc corresponding to a linear length of an outer curved face of the bow limb;

the upper and lower bow limb support arms defining a space between them a distance located outwardly from the central hub adequate to flex and hold therebetween the linear length portion of the outer curved face of the bow limb between the bow limb contact areas anywhere along the bow limb's linear length, when compressive force is applied by the bow limb support arms to the bow limb, allowing the bow limb to flex slightly into the space in a manner that increases a coefficient of friction between the outer curved face of the bow limb and the bow limb contact areas on the bow limb support arms and simultaneously holding the bow limb securely to the collective support using only the outer curved face of the bow limb and preventing the bow limb from flattening and losing contact with the bow limb contact areas, such that the upper and lower support arms of the collective supports are the only contact the bow has with the press during pressing.

2. The archery bow press of claim 1, wherein the upper support arm further comprises a concavely-curved inner limb contact surface and a convexly-curved outer limb contact surface, and the lower support arm further comprises a convexly-curved inner limb contact surface and a concavely-curved outer limb contact surface.

3. The archery bow press of claim 2, wherein the upper support arm comprises a recessed shoulder at a terminal end of its inner limb contact surface, and wherein the lower support arm comprises a recessed radius adjacent but spaced from a terminal end of its outer limb contact surface.

4. The archery bow press of claim 1, wherein the central hub comprises a broached hole inserted onto a spline pin.

5. The archery bow press of claim 4, wherein the central hub includes a tensioning screw to adjust tolerance between the broached hole and the spline pin.

6. The archery bow press of claim 4, wherein the broached hole is configured to rotate the central hub on an axis perpendicular to the common plane of the collective support.

7. The archery bow press of claim 1, wherein the upper and lower bow limb support arms are attached to the central hub in a coplanar direction configured to collectively contact an archery bow limb when the central hub is axially rotated with the bow press.

8. The archery bow press of claim 1, wherein the bow limb contact areas on the collective support comprise curved and notched shapes configured to engage an outside curvature of an archery bow limb.

9. The archery bow press of claim 1, wherein the upper and lower bow limb support arms further include multiple bow limb contact areas with various shapes adaptable to engage a bow limb or limb components of a bow limb, independently or collectively with each other.

10. A method for using a collective supports on an archery bow press to press a bow, comprising:

engaging a drive mechanism moving a pair of opposing arm members, each arm member operatively supporting a collective support to contact a respective limb of the bow; each collective support comprising spaced upper and lower bow limb support arms projecting outward at an acute angle from a central hub with the spaced upper and lower support arms acting as a single unified structure and set to straddle a linear length of an outer curved face of the respective bow limb at a flexible portion of the bow limb;

rotatively positioning the central hub on the bow press to rotatively position spaced bow limb contact areas on the spaced upper and lower support arms to simultaneously contact the outer curved face of the bow limb;

pressing the bow limb by applying a force through the collective support to the outer curved face of the bow limb with the upper and lower bow limb support arms positioned anywhere along the bow limb's linear length, thereby moving the bow limb in opposing directions along the bow limb's linear length toward and away from an associated cam and in a direction toward the central hub, and flexing a portion of the curved outer face of the bow limb slightly into a space between the spaced upper and lower bow limb support arms and thereby increasing a coefficient of friction against the bow limb contact areas, whereby the bow limb is held securely to the spaced upper and lower bow limb support arms using only the frictional contact between the upper and lower bow limb support arms, such that the frictional contact between the collective supports and the outer curved faces of the bow limbs is the only contact the press has with the bow during pressing.

* * * * *